US010167161B2

(12) United States Patent
Chang et al.

(10) Patent No.: US 10,167,161 B2
(45) Date of Patent: Jan. 1, 2019

(54) CONVEYANCE PATH SWITCHING MODULE AND PAPER SHEET HANDLING APPARATUS EQUIPPED THEREWITH

(71) Applicant: Masterwork Automodules Tech Corp. Ltd, Taipei (TW)

(72) Inventors: Yuan-Hao Chang, New Taipei (TW); Wen-Hsien Tsai, Taipei (TW)

(73) Assignee: Masterwork Automodules Tech Corp. Ltd, Taipei (TW)

( * ) Notice: Subject to any disclaimer, the term of this patent is extended or adjusted under 35 U.S.C. 154(b) by 0 days.

(21) Appl. No.: 15/641,234

(22) Filed: Jul. 4, 2017

(65) Prior Publication Data

US 2018/0040189 A1 Feb. 8, 2018

(30) Foreign Application Priority Data

Aug. 8, 2016 (TW) ..... 105125118 A

(51) Int. Cl.
*B65H 29/60* (2006.01)
*G07D 11/00* (2006.01)

(52) U.S. Cl.
CPC ..... *B65H 29/60* (2013.01); *G07D 11/0033* (2013.01); *G07D 11/0084* (2013.01); *B65H 2301/4455* (2013.01); *B65H 2301/44822* (2013.01); *B65H 2701/1912* (2013.01)

(58) Field of Classification Search
CPC ..... B65H 29/60; B65H 2301/4455; B65H 2301/44822; B65H 2404/63
See application file for complete search history.

(56) References Cited

U.S. PATENT DOCUMENTS 4,871,125 A 10/1989 Haueter
6,196,464 B1 * 3/2001 Patterson ..... B65H 29/006 235/474
7,802,787 B2 9/2010 Miwa
(Continued)

FOREIGN PATENT DOCUMENTS

| | | |
|---|---|---|
| CN | 102956058 | 3/2013 |
| EP | 2620921 | 7/2013 |
| WO | 2013111571 | 8/2013 |

OTHER PUBLICATIONS

"Search Report of European Counterpart Application," dated Jan. 3, 2018, p. 1-p. 7.

*Primary Examiner* — Patrick Cicchino
(74) *Attorney, Agent, or Firm* — JCIPRNET

(57) ABSTRACT

A conveyance path switching module includes a main body and a switching mechanism. The main body has first, second and third conveyance paths. The switching mechanism includes a first switching assembly and a second switching assembly. The first switching assembly and the second switching assembly are pivoted to the main body. By pivotally turning of the first switching assembly and the second switching assembly, the switching mechanism is adapted to be switched to a first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path.

17 Claims, 12 Drawing Sheets

(56) References Cited

U.S. PATENT DOCUMENTS

| | | | | |
|---|---|---|---|---|
| 8,167,304 | B2 | 5/2012 | Fukazawa et al. | |
| 8,579,279 | B2 | 11/2013 | Kagoshima et al. | |
| 8,695,977 | B2 * | 4/2014 | Nunn | B65H 39/10 271/303 |
| 8,827,269 | B2 * | 9/2014 | Yin | B65G 47/647 271/301 |
| 8,857,598 | B2 | 10/2014 | Iizuka et al. | |
| 2002/0074722 | A1 | 6/2002 | Dobrindt | |
| 2003/0057642 | A1 * | 3/2003 | Baker | B65H 29/60 271/303 |
| 2006/0280534 | A1 | 12/2006 | Cook et al. | |
| 2010/0213661 | A1 * | 8/2010 | Fukazawa | B65H 29/58 271/3.19 |
| 2014/0021011 | A1 * | 1/2014 | Yin | B65G 47/46 198/367 |

* cited by examiner

CONVEYANCE PATH SWITCHING MODULE AND PAPER SHEET HANDLING APPARATUS EQUIPPED THEREWITH

CROSS-REFERENCE TO RELATED APPLICATION

This application claims the priority benefit of Taiwan application serial no. 105125118, filed on Aug. 8, 2016. The entirety of the above-mentioned patent application is hereby incorporated by reference herein and made a part of this specification.

BACKGROUND

Field of the Invention

The invention relates to a switching module and a paper sheet handling apparatus is equipped with the switching module. More particularly, the invention is directed to a conveyance path switching module and a paper sheet handling apparatus is equipped with the conveyance path switching module.

Description of Related Art

An automated teller machine (ATM) can allow a user to deposit and withdraw banknotes, in which conveyance channels are provided for conveying banknotes for various operations. In order to control manners of conveying the banknotes in the ATM, switching modules need to be disposed on the conveyance channels in the ATM for switching paths for conveying the banknotes.

In some ATMs, the switching among the paths for conveying the banknotes is achieved by using a single actuator (e.g., an electromagnetic valve) with a component, for example, a corresponding linking rod. This design generally can be only utilized in switching a state of a single conveyance path, but fail to effectively convey the banknotes in various ways. Thus, how to switch states of more conveyance paths by using a limited number of actuators is an important issue regarding banknote dispensing design in the ATMs.

SUMMARY

The invention provides a conveyance path switching module providing a preferable conveyance path switching capability.

The invention provides a paper sheet handling apparatus with a conveyance path switching module providing a preferable conveyance path switching capability.

According to an embodiment, a conveyance path switching module of including a main body and a switching mechanism is provided. The main body has a first conveyance path, a second conveyance path and a third conveyance path adapted to convey an object. The switching mechanism includes a first switching assembly and a second switching assembly. The first switching assembly is pivoted to the main body. The second switching assembly is pivoted to the main body. By pivotally turning of the first switching assembly and pivotally turning of the second switching assembly, the switching mechanism is adapted to be switched to a first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path.

In an embodiment, the conveyance path switching module includes a plurality of rollers disposed on the main body and adapted to drive the object to move along the first conveyance path, the second conveyance path or the third conveyance path.

In an embodiment, one end of the first conveyance path connects with one end of the second conveyance path, the other end of the first conveyance path connects with one end of the third conveyance path, and the other end of the second conveyance path connects with the other end of the third conveyance path.

In an embodiment, the conveyance path switching module includes a first actuator and a second actuator. The first actuator is connected to the first switching assembly and adapted to drive the first switching assembly to turn, and the second actuator is connected to the second switching assembly and adapted to drive the second switching assembly to turn.

In an embodiment, the first switching assembly includes a first switching guide and a first shaft, the first switching guide is pivoted to the main body with the first shaft, the second switching assembly includes a second switching guide, a third switching guide and two second shafts, and the second switching guide and the third switching guide are pivoted to the main body respectively with the two second shafts.

In an embodiment, the switching mechanism is in the first state when the first switching guide is blocked on the second conveyance path, and the second switching guide and the third switching guide are blocked on the third conveyance path, the switching mechanism is in the second state when the first switching guide is blocked on the first conveyance path, and the second switching guide and the third switching guide are blocked on the third conveyance path, and the switching mechanism is in the third state when the second switching guide and the third switching guide are respectively blocked on the first conveyance path and the second conveyance path.

In an embodiment, the first switching guide and the second switching guide are adapted to guide the object to move in bi-direction along the first conveyance path when the switching mechanism is in the first state, the first switching guide and the third switching guide are adapted to guide the object to move in bi-direction along the second conveyance path when the switching mechanism is in the second state, and the second switching guide and the third switching guide are adapted to guide the object to move in bi-direction along the third conveyance path when the switching mechanism is in the third state.

In an embodiment, the second switching assembly further includes a third shaft and two linking rods, the second switching guide and the third switching guide are pivoted to each other with the third shaft, and the two second shafts are connected to the third shaft respectively with the two linking rods.

In an embodiment, the third shaft is adapted to move relatively to the first shaft along with rotation of one of the linking rods.

According to an embodiment, a paper sheet handling apparatus including a conveyance path switching module, an inlet, a discrimination section, at least two storage cassettes and a deposit conveyance unit. The conveyance path switching module includes a main body and a switching mechanism. The main body has a first conveyance path, a second conveyance path and a third conveyance path adapted to convey a paper sheet. The switching mechanism includes a first switching assembly and a second switching assembly. The first switching assembly is pivoted to the main body. The second switching assembly is pivoted to the main body. By pivotally turning of the first switching assembly and pivotally turning of the second switching assembly, the switching mechanism is adapted to be switched to a first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path. The inlet is for receiving the paper sheet into the paper sheet handling apparatus. The discrimination section is for discriminating the paper sheet. The storage cassettes is adapted to store the paper sheet. The deposit conveyance unit is adapted to convey the paper sheet from the inlet through the discrimination section, convey the paper sheet from the discrimination section to one of the storage cassettes through the first conveyance path when the switching mechanism is in the first state, convey the paper sheet from the discrimination section to another one of the storage cassettes through the second conveyance path when the switching mechanism is in the second state, and convey the paper sheet from one of the storage cassettes to another one of the storage cassettes through the third conveyance path when the switching mechanism is in the third state.

In an embodiment, the paper sheet handling apparatus further includes a temporary holding section. The paper sheet is adapted to be conveyed from the discrimination section to the temporary holding section. The paper sheet is adapted to move from the temporary holding section to one of the storage cassettes through the first conveyance path when the switching mechanism is in the first state, and the paper sheet is adapted to move from the temporary holding section to another one of the storage cassettes through the second conveyance path when the switching mechanism is in the second state.

According to an embodiment, a paper sheet handling apparatus including a conveyance path switching module, at least two storage cassettes, a discrimination section, an outlet and a withdrawal conveyance unit is provided. The conveyance path switching module includes a main body and a switching mechanism. The main body has a first conveyance path, a second conveyance path and a third conveyance path adapted to convey a paper sheet. The switching mechanism includes a first switching assembly and a second switching assembly. The first switching assembly is pivoted to the main body. The second switching assembly is pivoted to the main body. By pivotally turning of the first switching assembly and pivotally turning of the second switching assembly, the switching mechanism is adapted to be switched to first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path. The storage cassettes are adapted to store the paper sheet. The discrimination section is for discriminating the paper sheet. The outlet is for withdrawing the paper sheet from the paper sheet handling apparatus. The withdrawal conveyance unit is adapted to convey the paper sheet from the discrimination section to the outlet such that the paper sheet exits from the paper sheet handling apparatus through the outlet, convey the paper sheet from one of the storage cassettes to the discrimination section through the first conveyance path when the switching mechanism is in the first state, convey the paper sheet from another one of the storage cassettes to the discrimination section through the second conveyance path when the switching mechanism is in the second state, and convey the paper sheet from one of the storage cassettes to another one of the storage cassettes through the third conveyance path when the switching mechanism is in the third state.

In an embodiment, the paper sheet handling apparatus further includes a temporary holding section. The paper sheet is adapted to be conveyed from one of the storage cassettes to the temporary holding section through the first conveyance path when the switching mechanism is in the first state, and the paper sheet is adapted to be conveyed from another one of the storage cassettes to the temporary holding section through the second conveyance path, and the paper sheet is adapted to be conveyed from the temporary holding section to the discrimination section when the switching mechanism is in the second state.

In an embodiment, the first switching assembly includes a first switching guide and a first shaft, the first switching guide is pivoted to the main body with the first shaft, the second switching assembly includes a second switching guide, a third switching guide and two second shafts, and the second switching guide and the third switching guide are pivoted to the main body respectively with the two second shafts.

In an embodiment, the switching mechanism is in the first state when the first switching guide is blocked on the second conveyance path, and the second switching guide and the third switching guide are blocked on the third conveyance path, the switching mechanism is in the second state when the first switching guide is blocked on the first conveyance path, and the second switching guide and the third switching guide are blocked on the third conveyance path, and the switching mechanism is in the third state when the second switching guide and the third switching guide are respectively blocked on the first conveyance path and the second conveyance path.

In an embodiment, the first switching guide and the second switching guide are adapted to guide the paper sheet to move in bi-direction along the first conveyance path when the switching mechanism is in the first state, the first switching guide and the third switching guide are adapted to guide the paper sheet to move in bi-direction along the second conveyance path when the switching mechanism is in the second state, and the second switching guide and the third switching guide are adapted to guide the paper sheet to move in bi-direction along the third conveyance path when the switching mechanism is in the third state.

In an embodiment, the second switching assembly further includes a third shaft and two linking rods, the second switching guide and the third switching guide are pivoted to each other with the third shaft, and the two second shafts are connected to the third shaft respectively with the two linking rods.

In an embodiment, the third shaft is adapted to move relatively to the first shaft along with rotation of one of the linking rods.

Based on the above, in the conveyance path switching module, the switching among the first conveyance path, the second conveyance path and the third conveyance path can be achieved by the turning of the first switching assembly and the second switching assembly. Namely, the states of three conveyance paths (i.e., the first conveyance path, the second conveyance path and the third conveyance path) can be switched by respectively driving two switching assemblies (i.e., the first switching assembly and the second switching assembly) to turn with only two actuators, instead of switching the states of the three conveyance paths with three actuators. Thus, the number of the actuators as required can be reduced to save equipment cost and provide preferable conveyance path switching capability.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments and, together with the description, serve to explain the principles of the invention.

DESCRIPTION OF EMBODIMENTS

Figure 1:
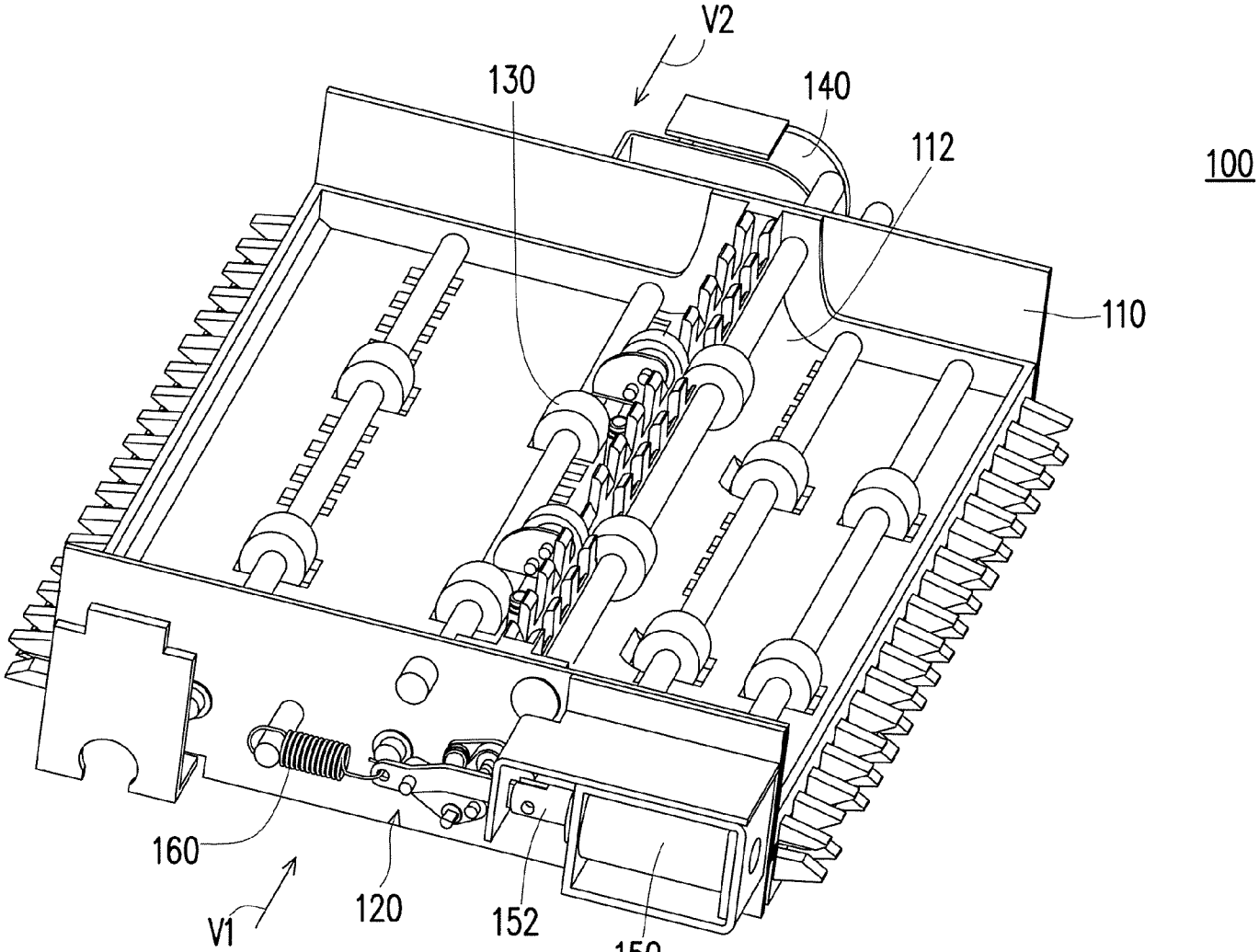
FIG. 1 is a perspective diagram illustrating a conveyance path switching module according to an embodiment.
Figure 2:
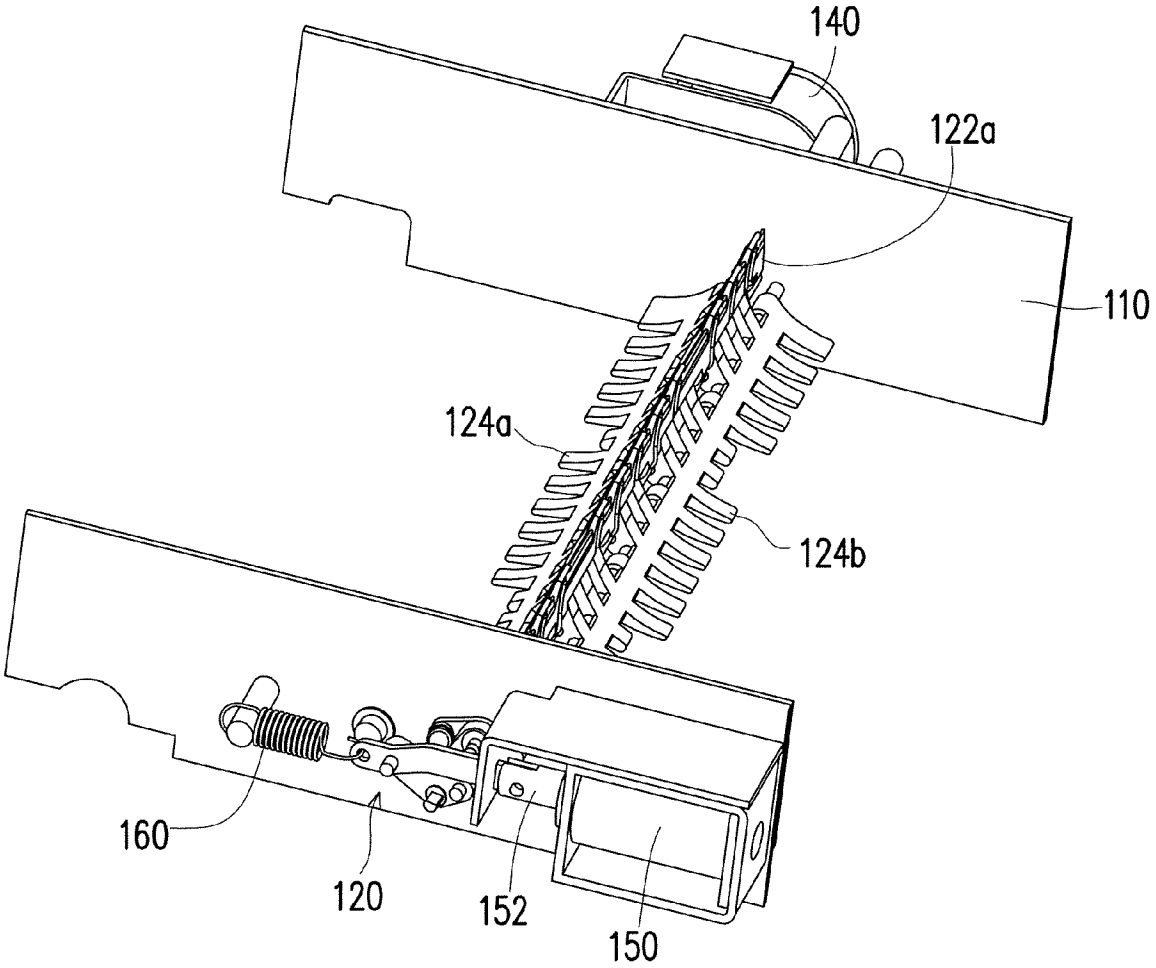
FIG. 2 is a perspective diagram illustrating a part of components of the conveyance path switching module depicted in FIG. 1.
Figure 3:
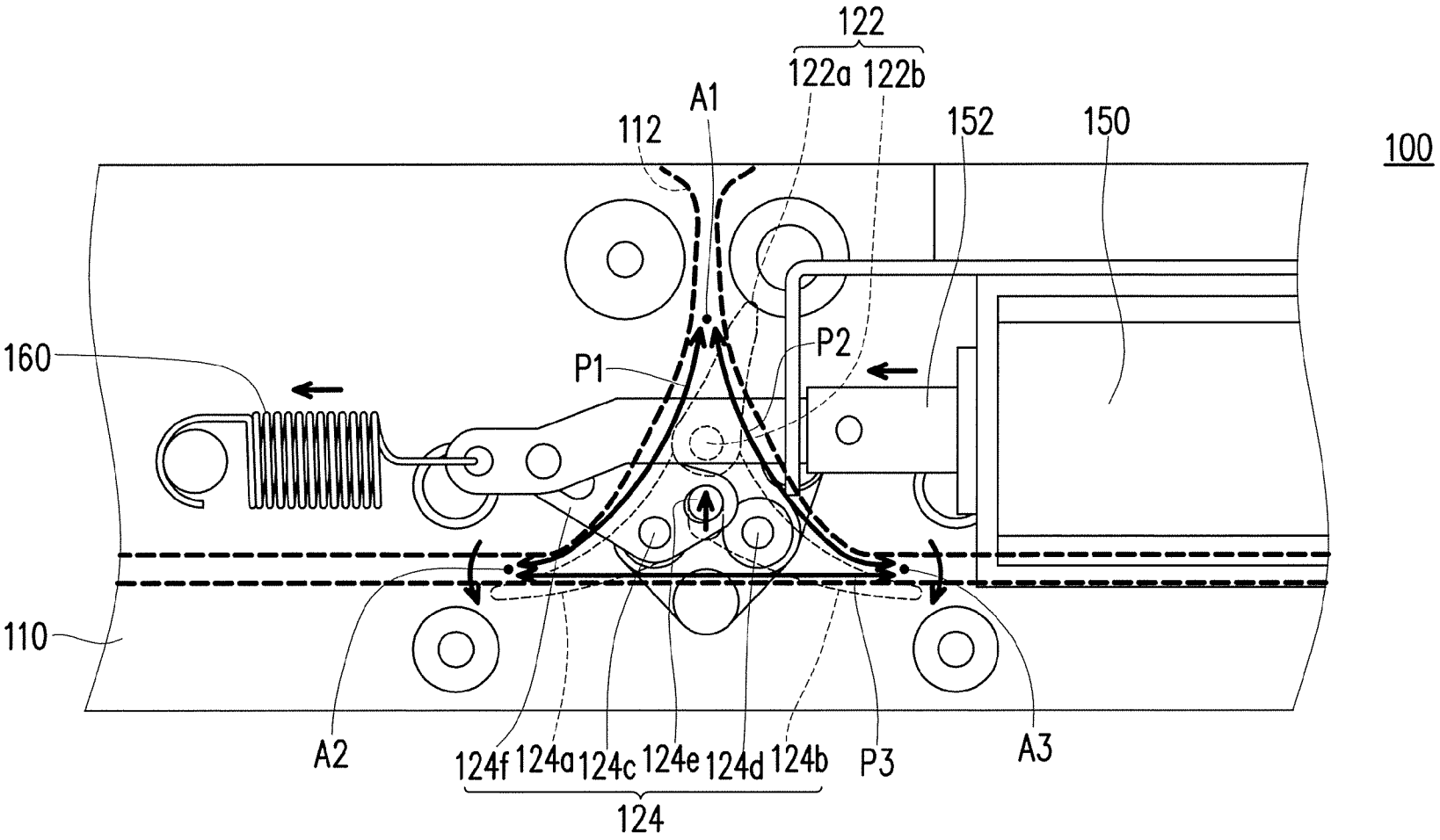
FIG. 3 is a side-view diagram illustrating the conveyance path switching module depicted in FIG. 1 in a viewing angle V1.

FIG. 1 is a perspective diagram illustrating a conveyance path switching module according to an embodiment. FIG. 2 is a perspective diagram illustrating a part of components of the conveyance path switching module depicted in FIG. 1. FIG. 3 is a side-view diagram illustrating the conveyance path switching module depicted in FIG. 1 in a viewing angle V1. Referring to FIG. 1 to FIG. 3, a conveyance path switching module 100 of the present embodiment includes a main body 110, a switching mechanism 120, a plurality of rollers 130, a first actuator 140 and a second actuator 150. The main body 110 has a first conveyance path P1, a second conveyance path P2 and a third conveyance path P3 adapted to convey an object. The aforementioned object is, for example, a paper sheet (e.g., a banknote or a check) or any other adaptive object, which is not limited in the invention. The rollers 130 are disposed on the main body 110 and adapted to drive the object to move along the first conveyance path P1, the second conveyance path P2 or the third conveyance path P3.

In the present embodiment, the first conveyance path P1, the second conveyance path P2 and the third conveyance path P3 are constituted by a banknote conveyance channel 112 of the main body 110 and the switching mechanism 120. One end of the first conveyance path P1 connects with on end of the second conveyance path P2 at a position A1, the other end of the first conveyance path P1 connects with one end of the third conveyance path P3 at a position A2, and the other end of the second conveyance path P2 connects with the other end of the third conveyance path P3 at a position A3. It should be noted that for clearer illustration, only a part of a contour of the banknote conveyance channel 112 is schematically shown in FIG. 3.

Figure 4A:
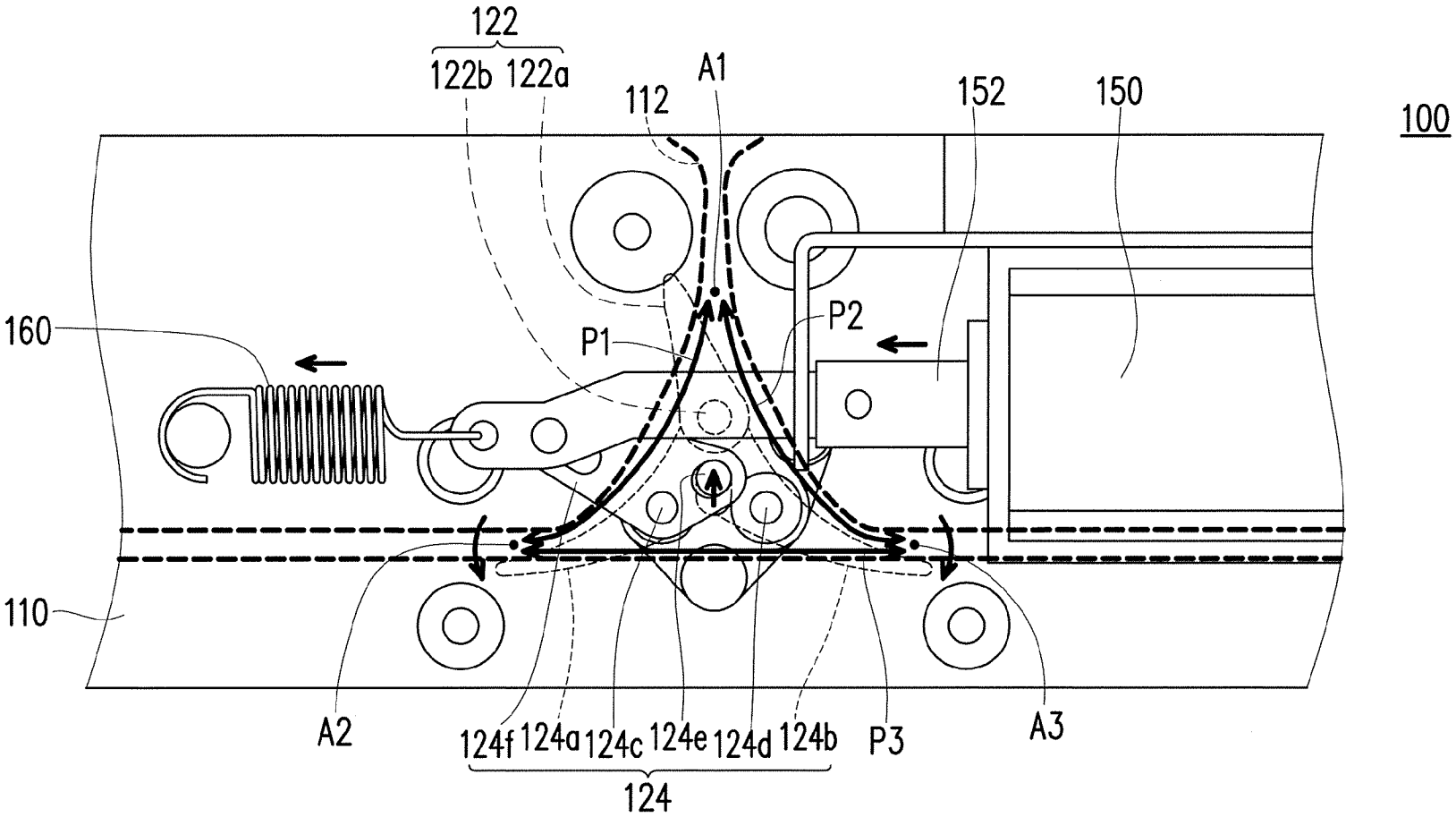
FIG. 4A and FIG. 4B illustrate pivotally turning of a first switching assembly and a second switching assembly depicted in FIG. 3.
Figure 4B:
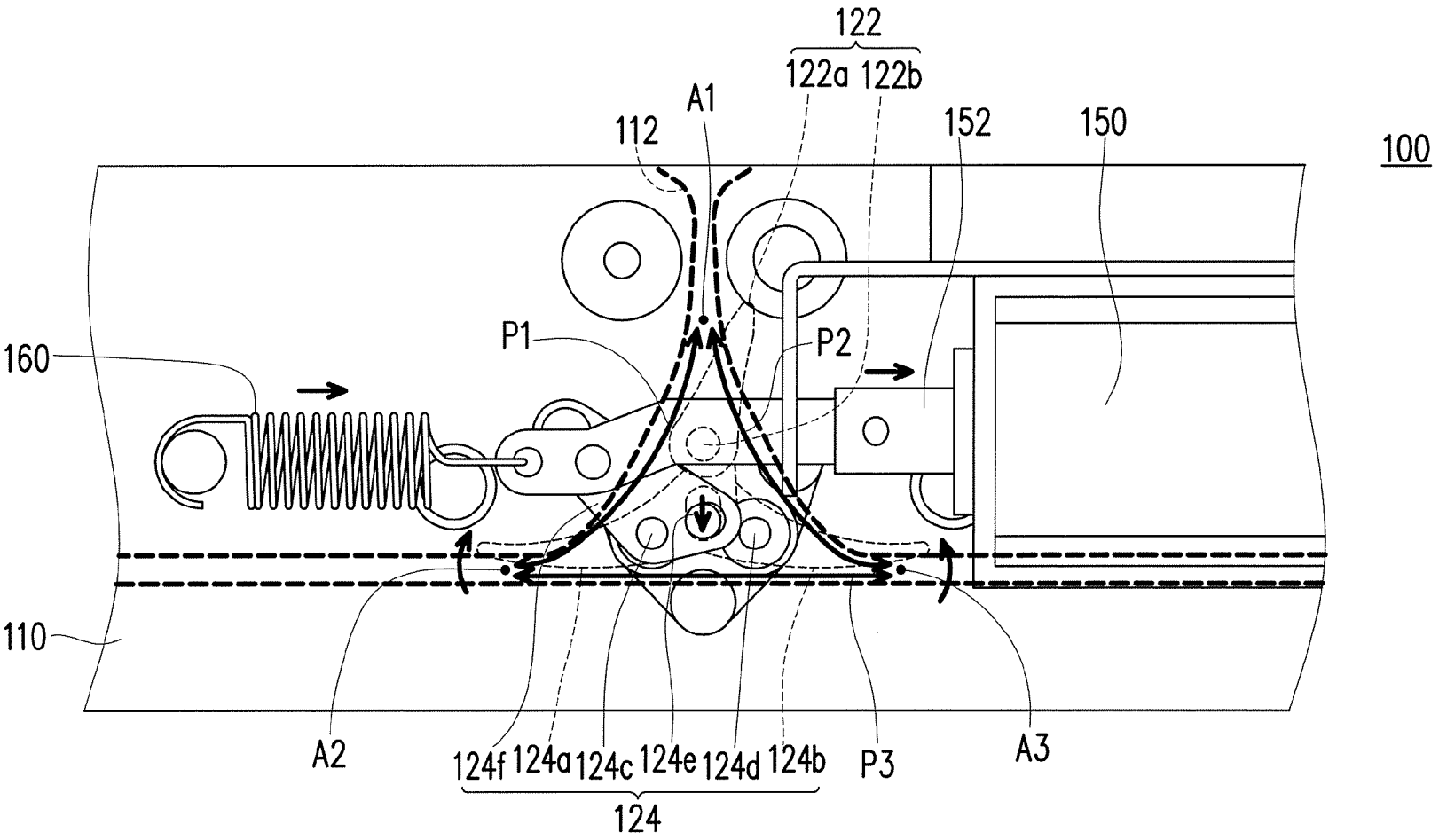
Figure 5A:
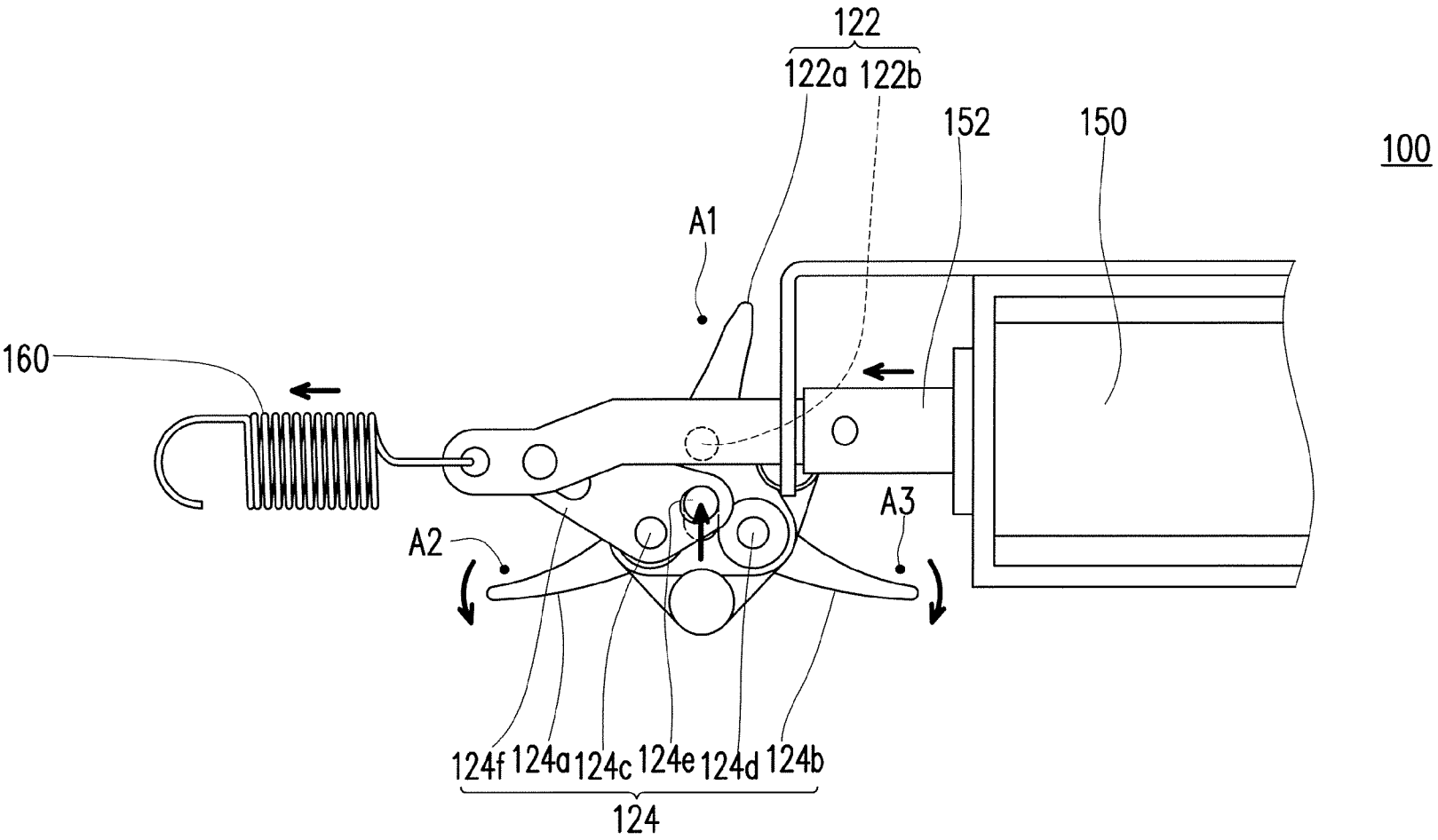
FIG. 5A and FIG. 5B are schematic diagrams respectively illustrating a part of the components depicted in FIG. 3 and a part of the components depicted in FIG. 4B.
Figure 5B:
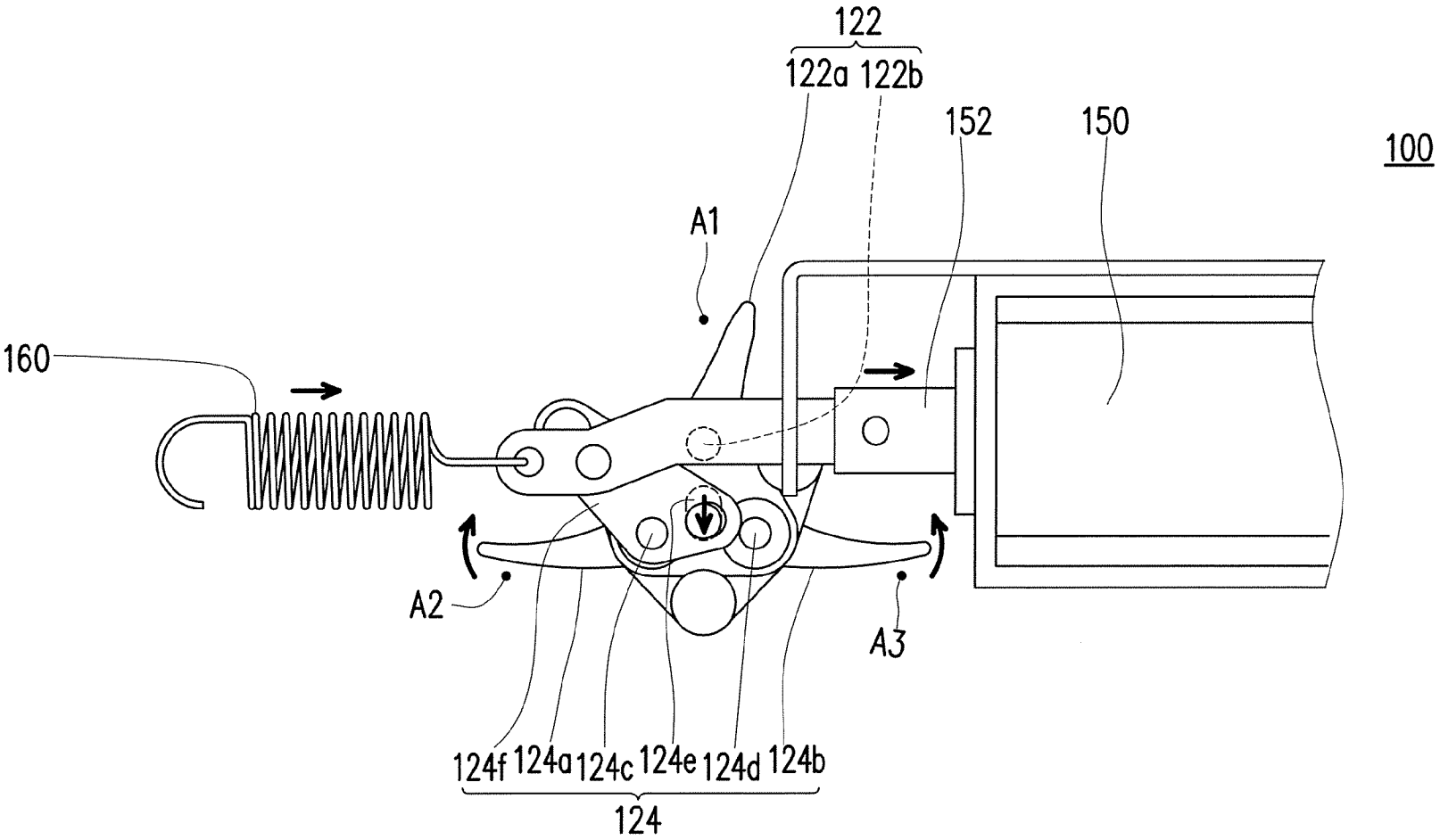
Figure 6A:
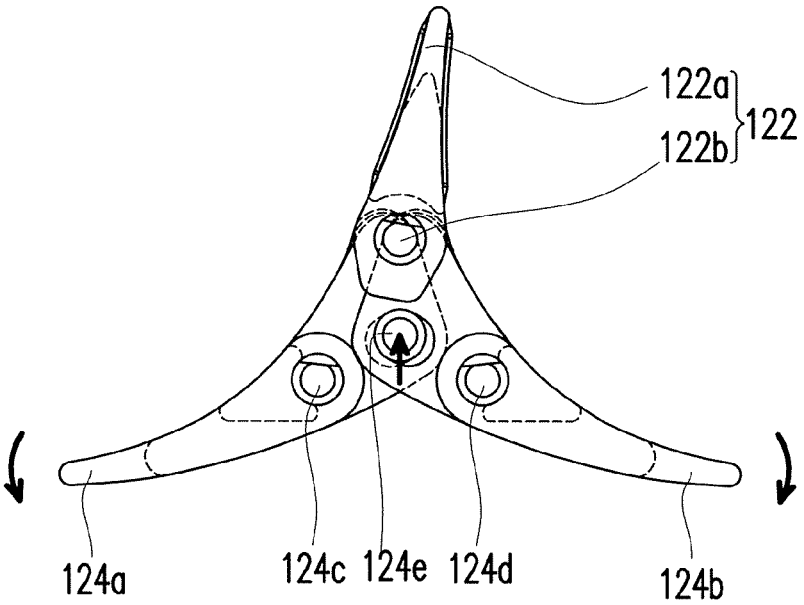
FIG. 6A and FIG. 6B are schematic diagrams respectively illustrating a part of the components depicted in FIG. 5A and a part of the components depicted in FIG. 5B.
Figure 6B:
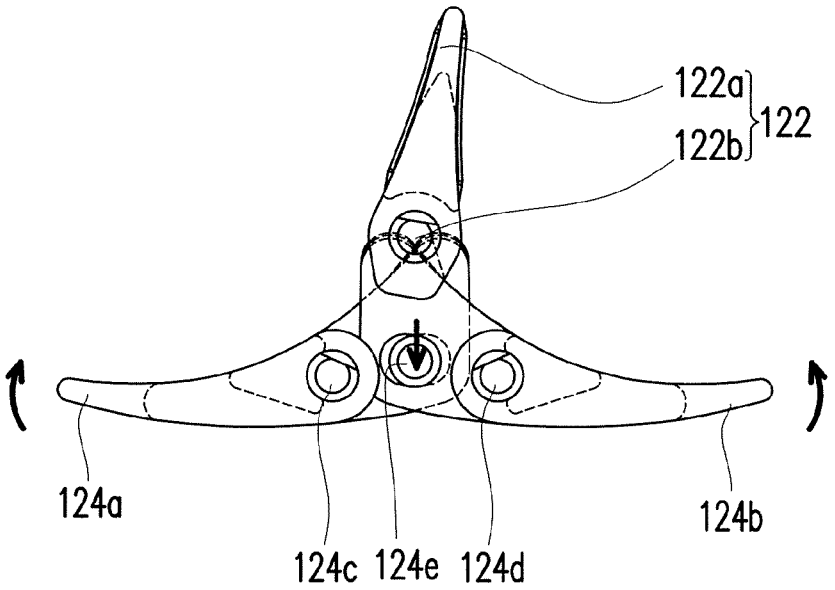
Figure 7A:
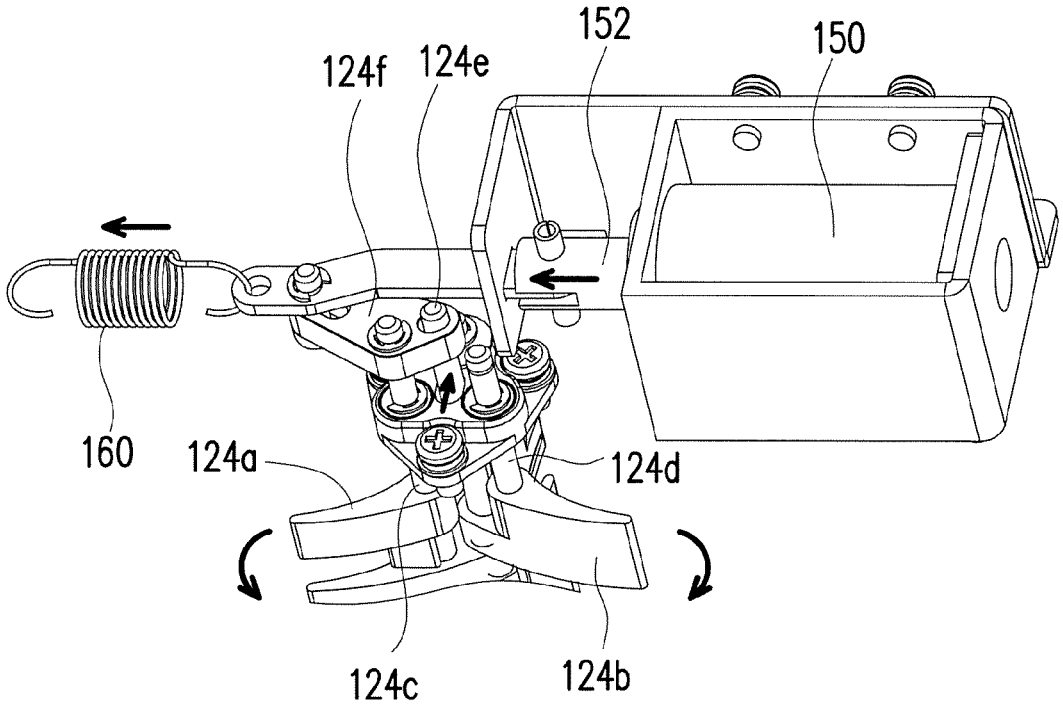
FIG. 7A and FIG. 7B are respectively perspective diagrams of FIG. 5A and FIG. 5B.
Figure 7B:
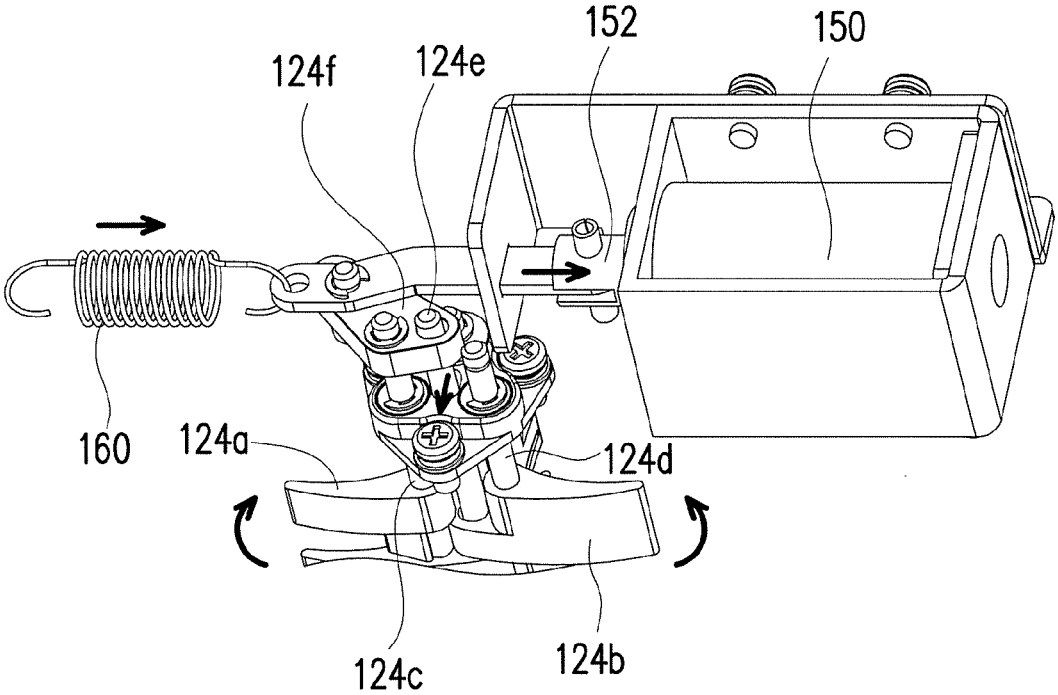

FIG. 4A and FIG. 4B illustrate pivotally turning of a first switching assembly and a second switching assembly depicted in FIG. 3. FIG. 5A and FIG. 5B are schematic diagrams respectively illustrating a part of the components depicted in FIG. 3 and a part of the components depicted in FIG. 4B. FIG. 6A and FIG. 6B are schematic diagrams respectively illustrating a part of the components depicted in FIG. 5A and a part of the components depicted in FIG. 5B. FIG. 7A and FIG. 7B are respectively perspective diagrams of FIG. 5A and FIG. 5B. The switching mechanism 120 includes a first switching assembly 122 and a second switching assembly 124. The first switching assembly 122 and the second switching assembly 124 are pivoted to the main body 110. The first actuator 140 and the second actuator 150 are, for example, electromagnetic valves, respectively connected to the first switching assembly 122 and the second switching assembly 124 and used to drive the first switching assembly 122 and the second switching assembly 124 to turn respectively. By pivotally turning of the first switching assembly 122 and pivotally turning of the second switching assembly 124, the switching mechanism 120 is adapted to be switched to a first state as illustrated in FIG. 3, FIG. 5A, FIG. 6A and FIG. 7A to open the first conveyance path P1 and close the second conveyance path P2 and the third conveyance path P3, adapted to be switched to a second state as illustrated in FIG. 4A to open the second conveyance path P2 and close the first conveyance path P1 and the third conveyance path P3, and adapted to be switched to a third state as illustrated in FIG. 4B and FIG. 5B to open the third conveyance path P3 and close the first conveyance path P1 and the second conveyance path P2.

In the aforementioned configuration, states of three conveyance paths (i.e., the first conveyance path P1, the second conveyance path P2 and the third conveyance path P3) may be switched by respectively driving two switching assemblies (i.e., the first switching assembly 122 and the second switching assembly 124) to turn using only two actuators (i.e., the first actuator 140 and the second actuator 150), instead of switching the states of the three conveyance paths by using three actuators. Thereby, the number of the actuators as required may be reduced to save equipment cost and provide preferable conveyance path switching capability. Therein, operations of the first actuator 140 and the second actuator 150 are controlled by, for example, a control unit (e.g., a computer).

Referring to FIG. 3, specifically, the first switching assembly 122 of the present embodiment includes a first switching guide 122*a* and a first shaft 122*b*. The first switching guide 122*a* is pivoted to the main body 110 with the first shaft 122*b*. The second switching assembly 124 of the present embodiment includes a second switching guide 124*a*, a third switching guide 124*b*, two second shafts 124*c* and 124*d*. The second switching guide 124*a* and the third switching guide 124*b* are pivoted to the main body 110 respectively with the two second shafts 124*c* and 124*d*. The first switching guide 122*a*, the second switching guide 124*a* and the third switching guide 124*b* may be solenoids, paper guides or other kinds of switching guides, and the invention is not limited thereto.

As illustrated in FIG. 3, FIG. 5A, FIG. 6A and FIG. 7A, when the first switching guide 122*a* is blocked on the second conveyance path P2, and the second switching guide 124*a* and the third switching guide 124*b* are blocked on the third conveyance path P3, the switching mechanism 120 is in the first state. As illustrated in FIG. 4A, when the first switching guide 122*a* is blocked on the first conveyance path P1, and the second switching guide 124*a* and the third switching guide 124*b* are blocked on the third conveyance path P3, the switching mechanism 120 is in the second state. As illustrated in FIG. 4B, FIG. 5B, FIG. 6B and FIG. 7B, when the second switching guide 124*a* and the third switching guide 124*b* are respectively blocked on the first conveyance path P1 and the second conveyance path P2, the switching mechanism 120 is in the third state. It should be noted that the first switching guide 122*a* is illustrated as being blocked on the second conveyance path P2 in the third state as illustrated in FIG. 4B and FIG. 5B only for exemplary illustration, and the first switching guide 122*a* may also be blocked on the first conveyance path P1 in the aforementioned third state.

Furthermore, when the switching mechanism 120 is in the first state as illustrated in in FIG. 3, FIG. 5A, FIG. 6A and FIG. 7A, the first switching guide 122*a* and the second switching guide 124*a*, with arc shapes, are adapted to guide the object to move in bi-direction along the first conveyance path P1. When the switching mechanism 120 is in the second state as illustrated in FIG. 4A, the first switching guide 122*a* and third switching guide 124*b*, with arc shapes, are adapted to guide the object to move in bi-direction along the second conveyance path P2. When the switching mechanism 120 is in the third state as illustrated in FIG. 4B, FIG. 5B, FIG. 6B and FIG. 7B, the second switching guide 124*a* and the third switching guide 124*b*, with arc shapes, are adapted to guide the object to move in bi-direction along the third conveyance path P3.

Namely, in the first state as illustrated in FIG. 3, FIG. 5A, FIG. 6A and FIG. 7A, the switching mechanism 120 may guide the object to move from the position A1 to the position A2 along the first conveyance path P1 and guide the object to move from the position A2 to the position A1 along the first conveyance path P1. In the second state as illustrated in FIG. 4A, the switching mechanism 120 may guide may guide the object to move from the position A1 to the position A3 along the second conveyance path P2 and guide the object to move from the position A3 to the position A1 along the second conveyance path P2. In the third state as illustrated in FIG. 4B, FIG. 5B, FIG. 6B and FIG. 7B, the switching mechanism 120 may guide the object to move from the position A2 to the position A3 along the third conveyance path P3 and guide the object to move from the position A3 to the position A2 along the third conveyance path P3.

Figure 8:
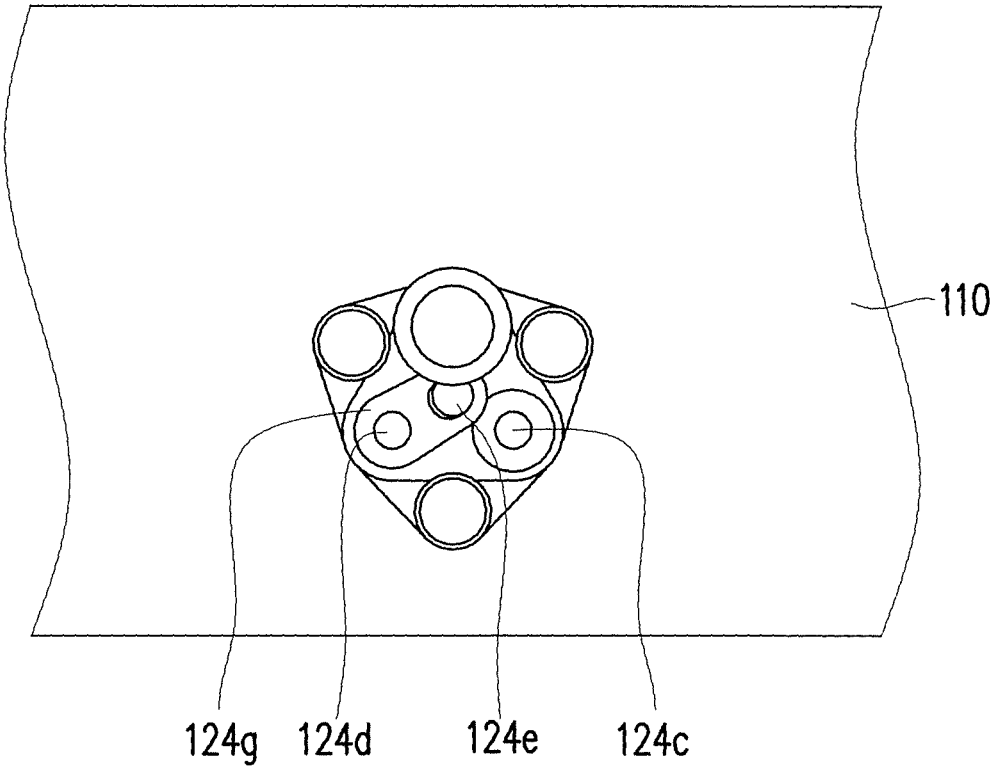
FIG. 8 is a side-view diagram illustrating a part of the components of the conveyance path switching module depicted in FIG. 1 in a viewing angle V2.

A manner of the first actuator 140 driving the first switching assembly 122 and a manner of the second actuator 150 driving the second switching assembly 124 of the present embodiment will be described in detail hereinafter. The first actuator 140 depicted in FIG. 1 is connected to the first shaft 122*b* depicted in FIG. 3 and adapted to drive the first shaft 122*b* to pivotally turn, thereby driving the first switching guide 122*a* to turn. FIG. 8 is a side-view diagram illustrating a part of the components of the conveyance path switching module depicted in FIG. 1 in a viewing angle V2. The second switching assembly 124 illustrated in FIG. 3 and FIG. 8 further includes a third shaft 124*e* and two linking rods 124*f* and 124*g*. The second switching guide 124*a* and the third switching guide 124*b* are pivoted to each other with the third shaft 124*e*, two second shafts 124*c* and 124*d* are connected to the third shaft 124*e* respectively with the two linking rods 124*f* and 124*g*, the second actuator 150 is connected to the linking rod 124*f* with a shaft 152, and an elastic member 160 is connected between the main body 110 and the shaft 152. In the state as illustrated in FIG. 1, the second actuator 150 does not operate, and the shaft 152 is maintained at the position illustrated in FIG. 1 by an elastic force of the elastic member 160. When the second actuator 150 operates to resist the elastic force of the elastic member 160 to cause the shaft 152 to move rightward, as illustrated in FIG. 4B and FIG. 5B, the shaft 152 drives the linking rod 124*f* to turn around the second shaft 124*c*, thereby driving the second switching guide 124*a* to turn. In addition, when the shaft 152 drives the linking rod 124*f* to turn around the second shafts 124*c* in the manner as described above, the third shaft 124*e* moves downward relatively to the first shaft 122*b* along with rotation of the linking rod 124*f* to drive the second shafts 124*d* to pivotally turn through the linking rod 124*g* illustrated in FIG. 8, thereby driving the third switching guide 124*b* to turn. When the second actuator 150 stops operating, the shaft 152 returns to its original position as illustrated in FIG. 3 by the elastic force of the elastic member 160, thereby driving the switching mechanism 120 to return to the state as illustrated in FIG. 3 FIG. 5A. In other embodiments, the first actuator 140 may drive the first switching assembly 122 in other adaptive manners, and the second actuator 150 may drive the second switching assembly 124 in other adaptive manners, which are not limited in the invention.

Figure 9:
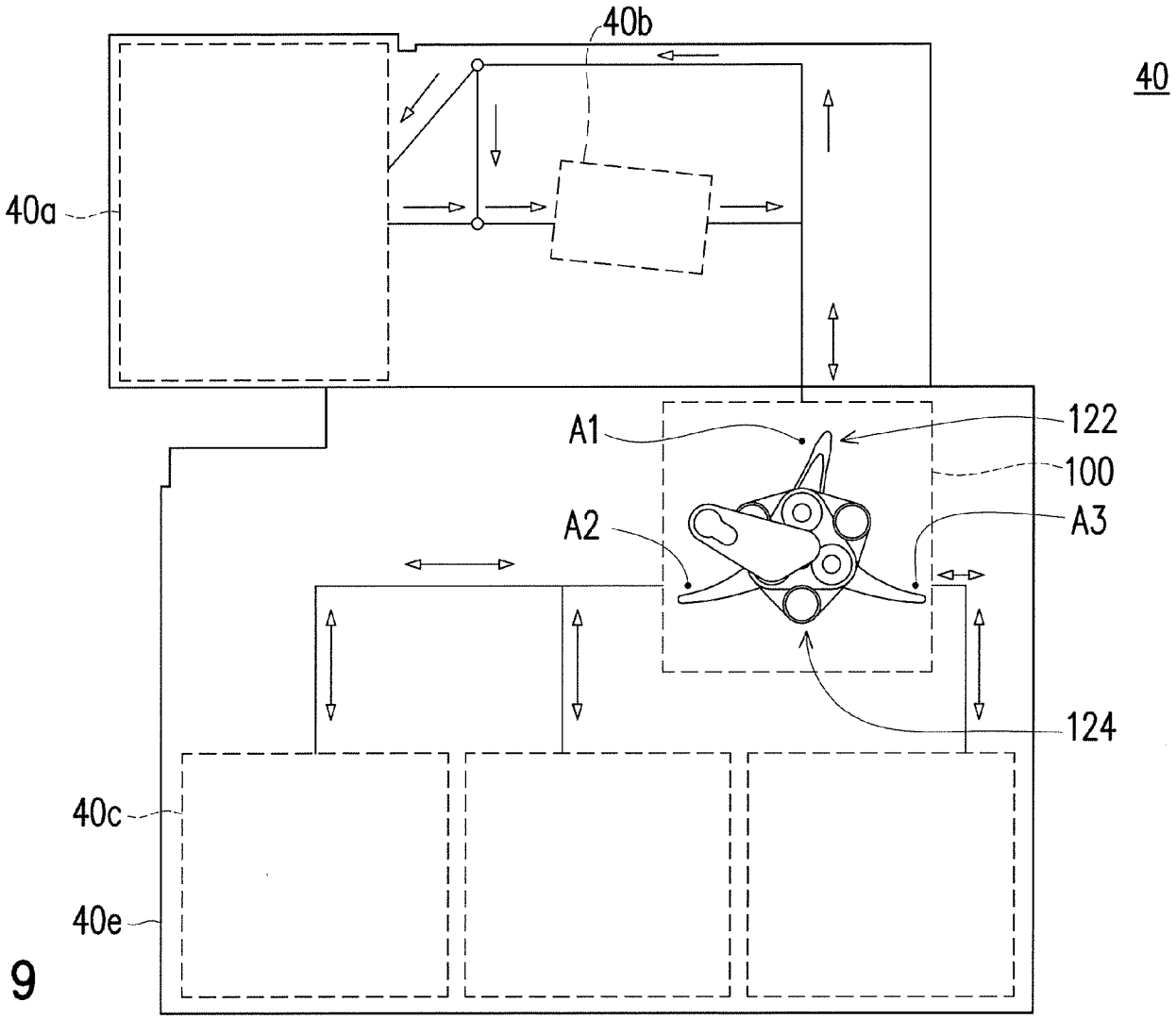
FIG. 9 illustrates that the conveyance path switching module depicted in FIG. 1 is applied in a paper sheet handling apparatus.

FIG. 9 illustrates that the conveyance path switching module depicted in FIG. 1 is applied in a paper sheet handling apparatus. Referring to FIG. 9, a paper sheet handling apparatus 40 includes an outlet/inlet 40*a*, a discrimination section 40*b*, a plurality of storage cassettes 40*c* and a safe 40*e*. An object (e.g., a banknote) is adapted to be received into the paper sheet handling apparatus 40 from the outlet/inlet 40*a* or exit from the paper sheet handling apparatus 40 through the outlet/inlet 40*a*. The discrimination section 40*b* is adapted to discriminate the object (e.g., the banknote). The storage cassettes 40*c* are adapted to store the object (e.g., the banknote) and installed inside the safe 40*e* to prevent from being stolen. The conveyance path switching module 100 is disposed between the safe 40*e* and the discrimination section 40*b* and used to switch conveyance paths of the object (e.g., the banknote). The conveyance paths of the conveyance path switching module applied in the paper sheet handling apparatus will be described in detail with reference to FIG. 10.

Figure 10:
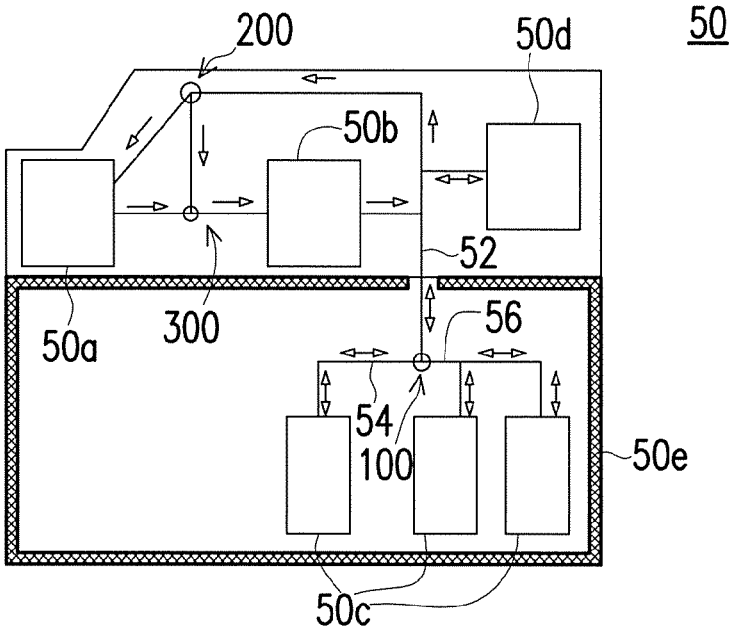
FIG. 10 is a schematic diagram illustrating the conveyance paths in the scenario that the conveyance path switching module depicted in FIG. 1 is applied in a paper sheet handling apparatus.

FIG. 10 is a schematic diagram illustrating the conveyance paths in the scenario that the conveyance path switching module depicted in FIG. 1 is applied in a paper sheet handling apparatus. Referring to FIG. 10, a paper sheet handling apparatus 50 of the present embodiment is, for example, an automated teller machine (ATM) and includes a plurality of conveyance channels (which are a first conveyance channel 52, a second conveyance channel 54 and a third conveyance channel 56 illustrated in FIG. 10). The first conveyance channel 52, the second conveyance channel 54 and the third conveyance channel 56 are, for example, respectively connected to the positions A1, A2 and A3 illustrated in FIG. 3. Namely, the first conveyance path P1 and the second conveyance path P2 illustrated in FIG. 3 intersect in the first conveyance channel 52 illustrated in FIG. 10, the first conveyance path P1 and the third conveyance path P3 illustrated in FIG. 3 intersect in the second conveyance channel 54 illustrated in FIG. 10, and the second conveyance path P2 and the third conveyance path P3 illustrated in FIG. 3 intersect in the third conveyance channel 56 illustrated in FIG. 10.

As illustrated in FIG. 10, the paper sheet handling apparatus 50 further includes an outlet/inlet 50*a*, a discrimination section 50*b*, a plurality of storage cassettes 50*c* and a temporary holding section 50*d*. The outlet/inlet 50*a* is provided, for example, for receiving or withdrawing the banknote (the paper sheet). The discrimination section 50*b* is, for example, a counterfeit bill detection module for discriminating the banknote (the paper sheet), the storage cassettes 50*c* are used to, for example, store banknotes, and the temporary holding section 50*d* is used to, for example, temporarily store banknotes. The above-mentioned conveyance channels connects the conveyance path switching module 100, the outlet/inlet 50*a*, the discrimination section 50*b* and the storage cassettes 50*c*. The conveyance path switching module 100 is connected to the discrimination section 50*b* through the first conveyance channel 52. The above-mentioned conveyance channels is adapted to convey an object (e.g., a banknote) between the conveyance path switching module 100 and the discrimination section 50*b* through the first conveyance channel 52. The conveyance path switching module 100 is also connected to the temporary holding section 50*d* through the first conveyance channel 52. The above-mentioned conveyance channels is adapted to convey the object (e.g., the banknote) between the conveyance path switching module 100 and the temporary holding section 50*d* through the first conveyance channel 52. In addition, the conveyance path switching module 100 is connected to the storage cassettes 50*c* through the second conveyance channel 54 and the third conveyance channel 56. The above-mentioned conveyance channels is adapted to convey the object (e.g., the banknote) between the conveyance path switching module 100 and the storage cassettes 50*c* through the second conveyance channel 54 and the third conveyance channel 56. In the aforementioned configuration, the object (e.g., the banknote) is conveyed in an arrow direction of each conveyance channel illustrated in FIG. 10, for example, for operations of banknote depositing, banknote withdrawing, banknote recycling, counterfeit bill detecting and banknote storage and so on.

An example is provided below for describing a deposit conveyance process after the object being received into the paper sheet handling apparatus 50 from the outlet/inlet 50*a*. The above-mentioned deposit conveyance process is provided by a deposit conveyance unit which include a combination of the above-mentioned conveyance channels, but the invention is not limited thereto. When the switching mechanism 100 is in the first state as illustrated in FIG. 3, the above-mentioned deposit conveyance unit is adapted to convey the object (e.g., the banknote) from the discrimination section 50*b* to one of the storage cassettes 50*c* (e.g., the leftmost storage cassette 50*c* illustrated in FIG. 10) through the first conveyance path P1. When the switching mechanism 100 is in the second state as illustrated in FIG. 4A, the above-mentioned deposit conveyance unit is adapted to convey the object (e.g., the banknote) from the discrimination section 50*b* to another one of the storage cassettes 50*c* (e.g., the storage cassette 50*c* in the middle or the rightmost storage cassette 50*c* illustrated in FIG. 10) through the second conveyance path P2.

It should be noted that the object (e.g., the banknote), after being identified by the discrimination section 50*b*, may also be first conveyed from the discrimination section 50*b* to the temporary holding section 50*d*. Then, when the switching mechanism 100 is in the first state as illustrated in FIG. 3, the above-mentioned deposit conveyance unit is adapted to convey the object (e.g., the banknote) from the temporary holding section 50*d* to one of the storage cassettes 50*c* (e.g., the leftmost storage cassette 50*c* illustrated in FIG. 10) through the first conveyance path P1, and when the switching mechanism 100 is in the second state as illustrated in FIG. 4A, the above-mentioned deposit conveyance unit is adapted to convey the object (e.g., the banknote) from the temporary holding section 50*d* to another one of the storage cassettes 50*c* (e.g., the storage cassette 50*c* in the middle or the rightmost storage cassette 50*c* illustrated in FIG. 10) through the second conveyance path P2.

An example is provided below for describing a withdrawal conveyance process that the object moves from the internal of the paper sheet handling apparatus 50 to the outlet/inlet 50*a*. The above-mentioned withdrawal conveyance process is provided by a withdrawal conveyance unit which includes a combination of the above-mentioned conveyance channels, but the invention is not limited thereto. When the switching mechanism 100 is in the first state as illustrated in FIG. 3, the above-mentioned withdrawal conveyance unit is adapted to convey the object (e.g., the banknote) from one of the storage cassettes 50*c* (e.g., the leftmost storage cassette 50*c* illustrated in FIG. 10) to the discrimination section 50*b* through the first conveyance path P1. When the switching mechanism 100 is in the second state as illustrated in FIG. 4A, the above-mentioned withdrawal conveyance unit is adapted to convey the object (e.g., the banknote) from another one of the storage cassettes 50*c* (e.g., the storage cassette 50*c* in the middle or the rightmost storage cassette 50*c* illustrated in FIG. 10) to the discrimination section 50*b* through the second conveyance path P2. The above-mentioned withdrawal conveyance unit is adapted to convey the object (e.g., the banknote) from the discrimination section 50*b* to the outlet/inlet 50*a* and exit from the paper sheet handling apparatus 50 through the outlet/inlet 50*a*.

It should be noted that when the switching mechanism 100 is in the first state, the above-mentioned withdrawal conveyance unit may also convey the object (e.g., the banknote) from one of the storage cassettes 50*c* (e.g., the leftmost storage cassette 50*c* illustrated in FIG. 10) to the temporary holding section 50*d* through the first conveyance path P1 and then, from the temporary holding section 50*d* to the discrimination section 50*c*. When the switching mechanism 100 is in the second state, the above-mentioned withdrawal conveyance unit may also convey the object (e.g., the banknote) from another one of the storage cassettes 50*c* (e.g., the storage cassette 50*c* in the middle or the rightmost storage cassette 50*c* illustrated in FIG. 10) to the temporary holding section 50*d* through the second conveyance path P2 and then, from the temporary holding section 50*d* to the discrimination section 50*c*.

In addition, when the switching mechanism is in the third state as illustrated in FIG. 4B, the above-mentioned withdrawal conveyance unit is adapted to convey the object (e.g., the banknote) from one of the storage cassettes 50*c* (e.g., the leftmost storage cassette 50*c* illustrated in FIG. 10) to another one of the storage cassettes 50*c* (e.g., the storage cassette 50*c* in the middle or the rightmost storage cassette 50*c* illustrated in FIG. 10) through the third conveyance path P3.

In the present embodiment, by concentrating the operation of switching the conveyance paths of the object (e.g., the banknote) in the conveyance path switching module 100, the safe 50*e* needs only a smaller number of openings (for example, an opening opened at the conveyance path switching module 100) for the object (e.g., the banknote) to be received into or exit therefrom, thereby preventing an anti-theft capability from being reduced due to the safe 50*e* having a great number of openings.

In addition, more conveyance path switching modules may be disposed at proper positions in the paper sheet handling apparatus based on demands. For instance, conveyance path switching modules 200 and 300 may be disposed adjacently to the outlet/inlet 50*a*. As illustrated in FIG. 3, specific structures of the conveyance path switching modules 200 and 300 may be, for example, similar to the conveyance path switching module 100 illustrated in FIG. 1. In other embodiments, more conveyance path switching modules may be further disposed at other proper positions, which is not limited in the invention.

Figure 11:
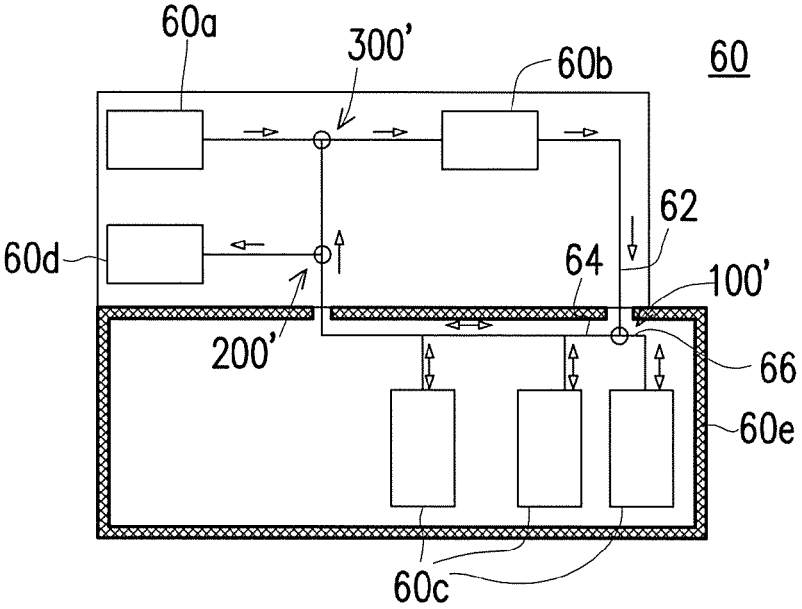
FIG. 11 is a schematic diagram illustrating conveyance paths in a paper sheet handling apparatus according to another embodiment.

FIG. 11 is a schematic diagram illustrating conveyance paths in a paper sheet handling apparatus according to another embodiment. In a paper sheet handling apparatus 60 illustrated in FIG. 11, functions of a conveyance path switching module 100', a conveyance path switching module 200', a conveyance path switching module 300', a first conveyance channel 62, a second conveyance channel 64, a third conveyance channel 66, an inlet 60*a*, an outlet 60*d*, a discrimination section 60*b*, storage cassettes 60*c*, a safe 60*e* are similar to the functions of the conveyance path switching module 100, the conveyance path switching module 200, the conveyance path switching module 300, the first conveyance channel 52, the second conveyance channel 54, the third conveyance channel 56, the outlet/inlet 50*a*, the discrimination section 50*b*, the storage cassettes 50*c* and the safe 50*e* illustrated in FIG. 10 and will not be repeatedly described hereinafter. Difference between the paper sheet handling apparatus 60 and the paper sheet handling apparatus 50 lies in that the inlet 60*a* and the outlet 60*d* are separately disposed, and the temporary holding section 50*d* depicted in FIG. 10 is not disposed in the paper sheet handling apparatus 60.

To summarize, in the conveyance path switching module, by the turning of the first switching assembly and the second switching assembly, the switching among the first conveyance path, the second conveyance path and the third conveyance path can be performed. Namely, the states of three conveyance paths (i.e., the first conveyance path, the second conveyance path and the third conveyance path) can be switched by respectively driving two switching assemblies (i.e., the first switching assembly and the second switching assembly) to turn with only two actuators, instead of switching the states of the three conveyance paths with three actuators. Thus, the number of the actuators as required can be reduced to be two actuators and provide preferable conveyance path switching capability.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A conveyance path switching module, comprising:

a main body, having a first conveyance path, a second conveyance path and a third conveyance path adapted to convey an object; and a switching mechanism, comprising:

a first switching assembly, pivoted to the main body; and a second switching assembly, pivoted to the main body, wherein by pivotally turning of the first switching assembly and pivotally turning of the second switching assembly, the switching mechanism is adapted to be switched to a first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path, wherein the first switching assembly comprises a first switching guide and a first shaft, the first switching guide is pivoted to the main body with the first shaft, the second switching assembly comprises a second switching guide, a third switching guide and two second shafts, the second switching guide and the third switching guide are pivoted to the main body respectively with the two second shafts, wherein the second switching assembly further comprises a third shaft and two linking rods, the second switching guide and the third switching guide are pivoted to each other with the third shaft, and the two second shafts are connected to the third shaft respectively with the two linking rods.

2. The conveyance path switching module according to claim 1, comprising a plurality of rollers disposed on the main body and adapted to drive the object to move along the first conveyance path, the second conveyance path or the third conveyance path.

3. The conveyance path switching module according to claim 1, one end of the first conveyance path connects with one end of the second conveyance path, the other end of the first conveyance path connects with one end of the third conveyance path, and the other end of the second conveyance path connects with the other end of the third conveyance path.

4. The conveyance path switching module according to claim 1, comprising a first actuator and a second actuator, wherein the first actuator is connected to the first switching assembly and adapted to drive the first switching assembly to turn, and the second actuator is connected to the second switching assembly and adapted to drive the second switching assembly to turn.

5. The conveyance path switching module according to claim 1, wherein the switching mechanism is in the first state when the first switching guide is blocked on the second conveyance path, and the second switching guide and the third switching guide are blocked on the third conveyance path, the switching mechanism is in the second state when the first switching guide is blocked on the first conveyance path, and the second switching guide and the third switching guide are blocked on the third conveyance path, and the switching mechanism is in the third state when the second switching guide and the third switching guide are respectively blocked on the first conveyance path and the second conveyance path.

6. The conveyance path switching module according to claim 1, wherein the first switching guide and the second switching guide are adapted to guide the object to move in bi-direction along the first conveyance path when the switching mechanism is in the first state, the first switching guide and the third switching guide are adapted to guide the object to move in bi-direction along the second conveyance path when the switching mechanism is in the second state, and the second switching guide and the third switching guide are adapted to guide the object to move in bi-direction along the third conveyance path when the switching mechanism is in the third state.

7. The conveyance path switching module according to claim 1, wherein the third shaft is adapted to move relatively to the first shaft along with rotation of one of the linking rods.

8. A paper sheet handling apparatus, comprising:

a conveyance path switching module, comprising:

a main body, having a first conveyance path, a second conveyance path and a third conveyance path adapted to convey a paper sheet; and a switching mechanism, comprising:

a first switching assembly, pivoted to the main body; and a second switching assembly, pivoted to the main body, wherein by pivotally turning of the first switching assembly and pivotally turning of the second switching assembly, the switching mechanism is adapted to be switched to a first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path;

an inlet, for receiving the paper sheet into the paper sheet handling apparatus;

a discrimination section, for discriminating the paper sheet;

at least two storage cassettes, adapted to store the paper sheet; and a deposit conveyance unit adapted to convey the paper sheet from the inlet through the discrimination section, convey the paper sheet from the discrimination section to one of the storage cassettes through the first conveyance path when the switching mechanism is in the first state, convey the paper sheet from the discrimination section to another one of the storage cassettes through the second conveyance path when the switching mechanism is in the second state, and convey the paper sheet from one of the storage cassettes to another one of the storage cassettes through the third conveyance path when the switching mechanism is in the third state, wherein the first switching assembly comprises a first switching guide and a first shaft, the first switching guide is pivoted to the main body with the first shaft, the second switching assembly comprises a second switching guide, a third switching guide and two second shafts, and the second switching guide and the third switching guide are pivoted to the main body respectively with the two second shafts, wherein the second switching assembly further comprises a third shaft and two linking rods, the second switching guide and the third switching guide are pivoted to each other with the third shaft, and the two second shafts are connected to the third shaft respectively with the two linking rods.

9. The paper sheet handling apparatus according to claim 8, further comprising a temporary holding section, wherein the paper sheet is adapted to be conveyed from the discrimination section to the temporary holding section, the paper sheet is adapted to move from the temporary holding section to one of the storage cassettes through the first conveyance path when the switching mechanism is in the first state, and the paper sheet is adapted to move from the temporary holding section to another one of the storage cassettes through the second conveyance path when the switching mechanism is in the second state.

10. The paper sheet handling apparatus according to claim 8, wherein the switching mechanism is in the first state when the first switching guide is blocked on the second conveyance path, and the second switching guide and the third switching guide are blocked on the third conveyance path, the switching mechanism is in the second state when the first switching guide is blocked on the first conveyance path, and the second switching guide and the third switching guide are blocked on the third conveyance path, and the switching mechanism is in the third state when the second switching guide and the third switching guide are respectively blocked on the first conveyance path and the second conveyance path.

11. The paper sheet handling apparatus according to claim 8, wherein the first switching guide and the second switching guide are adapted to guide the paper sheet to move in bi-direction along the first conveyance path when the switching mechanism is in the first state, the first switching guide and the third switching guide are adapted to guide the paper sheet to move in bi-direction along the second conveyance path when the switching mechanism is in the second state, and the second switching guide and the third switching guide are adapted to guide the paper sheet to move in bi-direction along the third conveyance path when the switching mechanism is in the third state.

12. The paper sheet handling apparatus according to claim 8, wherein the third shaft is adapted to move relatively to the first shaft along with rotation of one of the linking rods.

13. A paper sheet handling apparatus, comprising:

a conveyance path switching module, comprising:

a main body, having a first conveyance path, a second conveyance path and a third conveyance path adapted to convey a paper sheet; and a switching mechanism, comprising:

a first switching assembly, pivoted to the main body; and a second switching assembly, pivoted to the main body, wherein by pivotally turning of the first switching assembly and pivotally turning of the second switching assembly, the switching mechanism is adapted to be switched to a first state to open the first conveyance path and close the second conveyance path and the third conveyance path, adapted to be switched to a second state to open the second conveyance path and close the first conveyance path and the third conveyance path, and adapted to be switched to a third state to open the third conveyance path and close the first conveyance path and the second conveyance path, at least two storage cassettes, adapted to store the paper sheet;

a discrimination section, for discriminating the paper sheet;

an outlet, for withdrawing the paper sheet from the paper sheet handling apparatus; and a withdrawal conveyance unit adapted to convey the paper sheet from the discrimination section to the outlet such that the paper sheet exits from the paper sheet handling apparatus through the outlet, convey the paper sheet from one of the storage cassettes to the discrimination section through the first conveyance path when the switching mechanism is in the first state, convey the paper sheet from another one of the storage cassettes to the discrimination section through the second conveyance path when the switching mechanism is in the second state, and convey the paper sheet from one of the storage cassettes to another one of the storage cassettes through the third conveyance path when the switching mechanism is in the third state, wherein the first switching assembly comprises a first switching guide and a first shaft, the first switching guide is pivoted to the main body with the first shaft, the second switching assembly comprises a second switching guide, a third switching guide and two second shafts, and the second switching guide and the third switching guide are pivoted to the main body respectively with the two second shafts, wherein the second switching assembly further comprises a third shaft and two linking rods, the second switching guide and the third switching guide are pivoted to each other with the third shaft, and the two second shafts are connected to the third shaft respectively with the two linking rods.

14. The paper sheet handling apparatus according to claim 13, further comprising a temporary holding section, wherein the paper sheet is adapted to be conveyed from one of the storage cassettes to the temporary holding section through the first conveyance path when the switching mechanism is in the first state, and the paper sheet is adapted to be conveyed from another one of the storage cassettes to the temporary holding section through the second conveyance path, and the paper sheet is adapted to be conveyed from the temporary holding section to the discrimination section when the switching mechanism is in the second state.

15. The paper sheet handling apparatus according to claim 13, wherein the switching mechanism is in the first state when the first switching guide is blocked on the second conveyance path, and the second switching guide and the third switching guide are blocked on the third conveyance path, the switching mechanism is in the second state when the first switching guide is blocked on the first conveyance path, and the second switching guide and the third switching guide are blocked on the third conveyance path, and the switching mechanism is in the third state when the second switching guide and the third switching guide are respectively blocked on the first conveyance path and the second conveyance path.

16. The paper sheet handling apparatus according to claim 13, wherein the first switching guide and the second switching guide are adapted to guide the paper sheet to move in bi-direction along the first conveyance path when the switching mechanism is in the first state, the first switching guide and the third switching guide are adapted to guide the paper sheet to move in bi-direction along the second conveyance path when the switching mechanism is in the second state, the second switching guide and the third switching guide are adapted to guide the paper sheet to move in bi-direction along the third conveyance path when the switching mechanism is in the third state.

17. The paper sheet handling apparatus according to claim 13, wherein the third shaft is adapted to move relatively to the first shaft along with rotation of one of the linking rods.

* * * * *